United States Patent [19]

McConnell

[11] 4,021,706

[45] May 3, 1977

[54] POWER TRANSMISSION

[75] Inventor: George A. McConnell, Southfield, Mich.

[73] Assignee: Sperry Rand Corporation, Troy, Mich.

[22] Filed: Oct. 2, 1975

[21] Appl. No.: 618,866

[52] U.S. Cl. ..... 361/210; 361/159; 361/197

[51] Int. Cl.[2] ..... H01A 47/00

[58] Field of Search ..... 317/DIG. 4, 66, 137, 317/154, 155.5, 148.5 B

[56] References Cited

UNITED STATES PATENTS

| | | | |
|---|---|---|---|
| 3,495,154 | 2/1970 | Dosch et al. | 317/148.5 B |
| 3,558,995 | 1/1971 | Swinehart | 317/148.5 B |
| 3,577,040 | 5/1971 | Campbell | 317/DIG. 4 |
| 3,766,432 | 10/1973 | Markowitz et al. | 317/DIG. 6 |

*Primary Examiner*—Harry Moose

*Attorney, Agent, or Firm*—Theodore Van Meter

[57] ABSTRACT

A solid state switching circuit for applying rectified alternating current to one or the other of two solenoid valve actuators and modulating that current from a pull-in value to a lower holding value has a separate power circuit for each solenoid and a common timing and trigger circuit. Each power circuit contains a pair of diodes and a pair of silicon controlled rectifiers connected in a bridge circuit to supply its solenoid. The common timing and triggering circuit is connected to be energized whenever either power circuit is energized and contains a first DIAC control circuit for supplying triggering pulses early in each AC cycle and a second DIAC circuit for supplying pulses late in each AC cycle. The DIACs feed a coupling transformer which is coupled to the silicon controlled rectifiers of both power circuits. A time delay circuit biases a transistor to the on state after a predetermined time interval to disable the first DIAC control circuit.

3 Claims, 2 Drawing Figures

POWER TRANSMISSION

Solenoids are widely used to actuate valves partaking of longitudinal movement and because of the ease with which they may be controlled by a simple manual or automatically operated on-off switch, are widely favored. Where the power supply is alternating current this presents certain drawbacks requiring either a large and inefficient AC solenoid or the smaller direct current solenoid which requires both a pull-in coil and a hold-in coil and a mechanical switch to cut out the pull-in coil when the solenoid is engaged. While both systems provide the advantage of ready controlability, it is only accomplished at the expense of efficiency, the generation of heat poor reliability, short operating life and comparatively high cost.

The present invention aims to provide a switching and control system for single coil direct current solenoids, using an AC supply feeding an all solid state control circuit, thereby to achieve greater efficiency, reliability and durability in a compact, low cost package.

The invention achieves this aim by providing a solid state switching system for rectifying and modulating the application of direct current from an alternating current source to a pair of alternately energizable solenoids for operating a directional valve and which comprises a power circuit for each solenoid containing a pair of silicon controlled rectifiers and a pair of diodes connected in a bridge to supply dual wave rectified current to the solenoid, a common trigger circuit coupled to each power circuit at the silicon controlled rectifier half of the bridge and comprising a first DIAC control circuit for providing a triggering pulse to the power circuit early in the cycle to provide full voltage to the solenoid, a second DIAC control circuit for providing a triggering pulse to the power circuit late in the cycle to provide a low voltage to the solenoid, a timing circuit including a transistor connected to disable the first DIAC control circuit when the transistor is biased to the on state and means for delaying the application of a bias to the transistor, the timing circuit being connected to the power circuits through opposing diodes whereby energizing either power circuit will energize the timing circuit without energizing the other power circuit. IN THE DRAWING:

Figure 1:
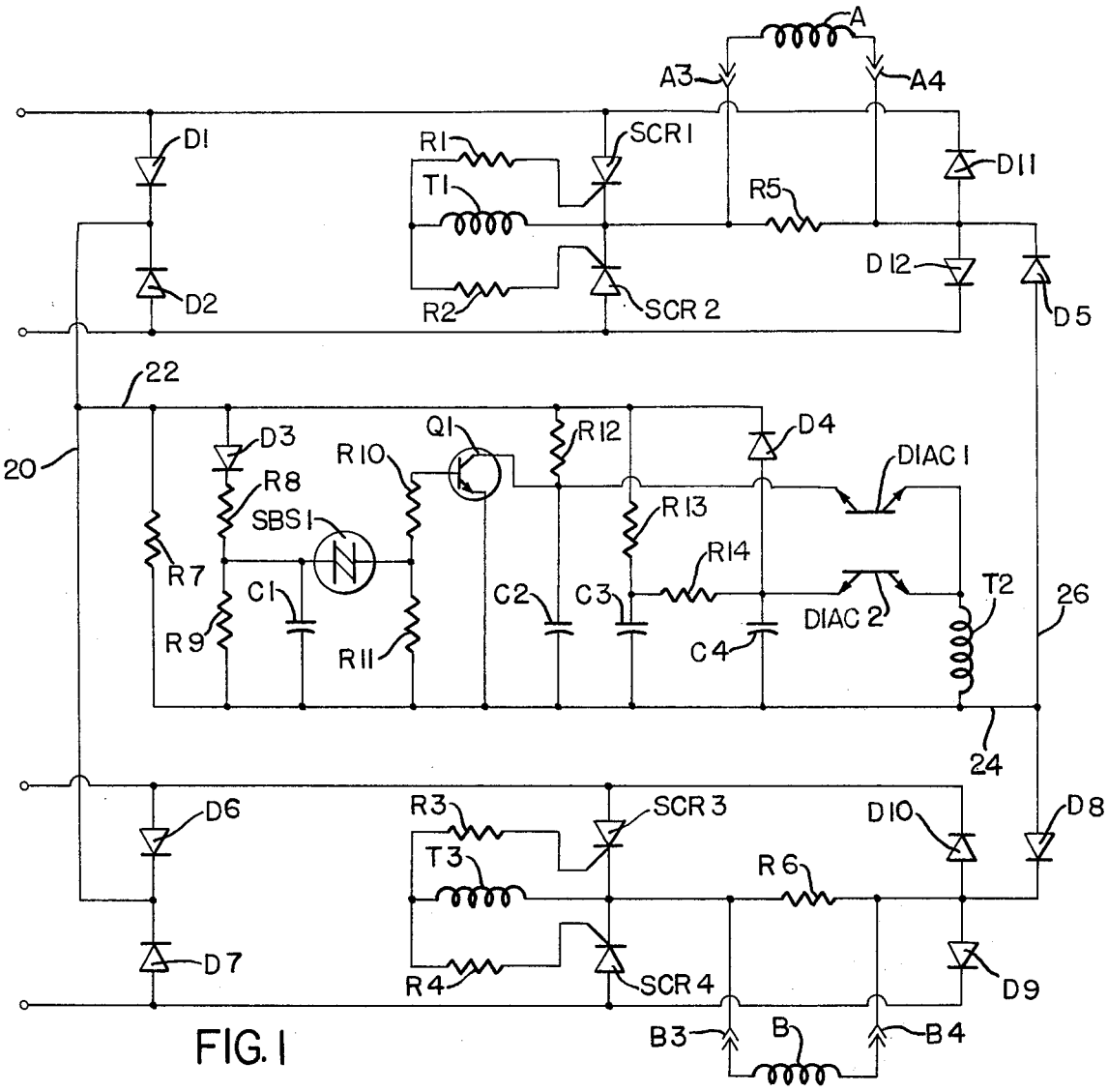
FIG. 1 is a circuit diagram of a solid state switching system for controlling a pair of solenoids embodying a preferred form of the present invention.
Figure 2:
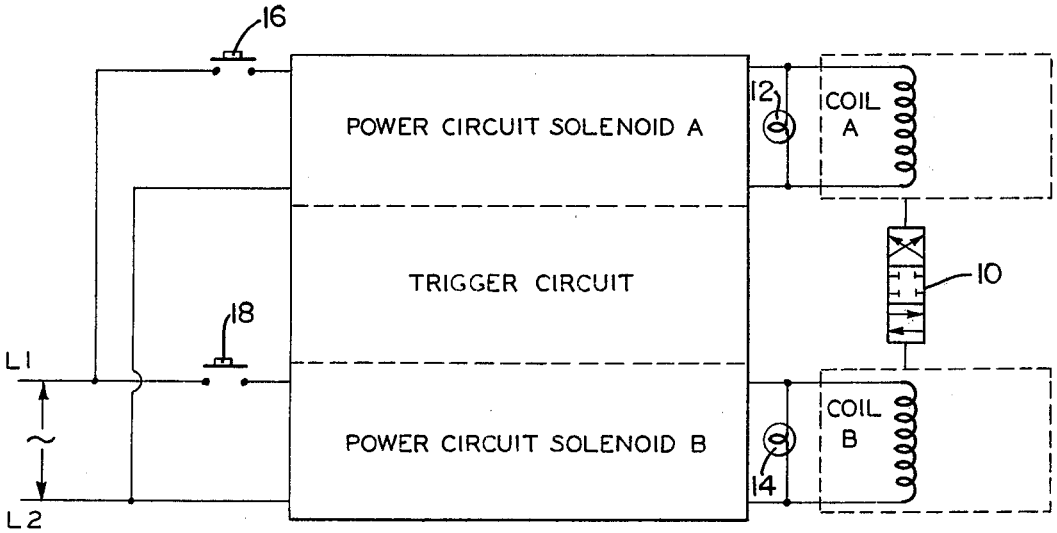
FIG. 2 is a block diagram illustrating the application of the circuit of FIG. 1.

Referring first to FIG. 2, opposed solenoid coils A and B are illustrated as controlling a spring centered directional valve 10. Suitable indicator lights 12 and 14 may be provided to signal whichever solenoid is energized. Each solenoid has its own power circuit which is supplied from AC lines L1 and L2 to selector switches 16 and 18. These may be either manually or automatically operated and may be interlocked electrically or mechanically to prevent simultaneous energization of both power circuits. The power circuit for solenoid A includes a bridge across the AC supply consisting of the diodes D11 and D12 and the silicon controlled rectifiers SCR1 and SCR2. The output of the bridge is fed to the coil A through plug-in connectors A3 and A4 and to a shunt resistor R5. One coil T-1 of a coupling transformer is connected through resistors R1 and R2 to trigger SCR1 and SCR2 respectively. The power circuit for solenoid B as is apparent from FIG. 1 is identical to the power circuit for solenoid A, but with the components being identified with different reference characters.

One terminus of the trigger circuit is connected to the AC input of each power circuit through the respective diode pairs D1-D2 and D6-D7 and connections 20 and 22. The opposite terminus 24 of the trigger circuit is connected through diodes D5 and D8 to the respective power circuits at the diode half of the bridge of each. This provides alternating current to the trigger circuit when either power circuit is energized, but does not allow flow of alternating current to the opposite power circuit.

There are two trigger circuits which feed the coil T2 of the coupling transformer which is inductively coupled to the coils T1 and T3 of the power circuits. The first trigger circuit comprises a resistor R12, the condenser C2 and the DIAC 1 with the resistance and capacitance values being selected to provide a trigger pulse early in each rectified AC cycle. A second trigger circuit comprising resistors R13 and R14 and condensers C3 and C4 together with DIAC 2 have such values of their components that the triggering pulses are supplied to coil T2 only during the late part of each rectified AC cycle.

For the purpose of cutting out the first trigger circuit after a predetermined time interval, the timing circuit is provided which consists of the transistor Q1, the diode D3, the resistors R8, R9, R10 and R11, the condenser C1 and the silicon bilateral switch SBS1. A resistor R7 and the diode D4 provide a discharge path for the condenser C4 between cycles.

In operation whenever one of the mechanical switches is closed, for example switch 16, power circuit for solenoid A will be energized and the trigger circuit will be energized through diode D1 or D2, diode D5, and diode D11 or D12. Diode D8 will block flow through the power circuit for solenoid B. The first trigger circuit controlling DIAC 1 will fire the DIAC early in each cycle, sending a triggering pulse through transformer coil T2 to be received at coil T1 to trigger the appropriate SCR1 or SCR2. Thus full wave rectified current is supplied at substantially line voltage to the coil A.

Since the timing circuit is also energized, resistor R8 will build up voltage in condenser C1 until it is high enough to fire SBS 1 which accordingly biases the transistor Q1 to the on state, thus bypassing condenser C2 and disabling the first trigger circuit controlling DIAC 1. Thus the high voltage pull-in current through solenoid coil A is discontinued and thereafter a low voltage holding current continues as long as switch 16 remains closed.

This low voltage holding current is produced by the second trigger circuit R13 which charges condensers C3 and C4 until their voltage reaches the firing voltage for DIAC 2 which occurs late in each cycle, thus triggering the appropriate SCR to deliver only a low voltage for holding purposes to the coil A. The action for energizing solenoid coil B is similar to that described and is under the control of switch 18.

I claim:

1. A solid state switching system for rectifying and modulating the application of direct current from an alternating current source to a pair of alternately energizable solenoids for operating a directional valve comprising a power circuit for each solenoid containing a pair of silicon controlled rectifiers and a pair of diodes connected in a bridge to supply a dual wave rectified current to the solenoid, a common trigger circuit coupled to each power circuit at the silicon controlled rectifier half of the bridge and comprising a first DIAC control circuit for providing a triggering pulse to the power circuit early in the cycle to provide full voltage to the solenoid, a second DIAC control circuit for providing a triggering pulse to the power circuit late in the cycle to provide a low voltage to the solenoid, a timing circuit including a transistor connected to disable the first DIAC control circuit when the transistor is biased to the on state and means for delaying the application of a bias to the transistor, the timing circuit being connected to the power circuits through opposing diodes whereby energizing either power circuit will energize the timing circuit without energizing the other power circuit.

2. A system as defined in claim 1 wherein the timing circuit is coupled to both power circuits through a three-winding transformer.

3. A system as defined in claim 1 wherein the timing circuit includes a silicon bilateral switch and a resistor-condenser network for providing a delayed voltage build-up to the silicon bilateral switch causing it to fire and bias the transistor.

* * * * *